United States Patent [19]

Mattei et al.

[11] Patent Number: 4,574,646

[45] Date of Patent: Mar. 11, 1986

[54] METHOD FOR SAMPLING CIGARETTES ON A FILTER ASSEMBLY MACHINE

[75] Inventors: Riccardo Mattei; Armando Neri, both of Bologna, Italy

[73] Assignee: G.D. Societá per Azioni, Bologna, Italy

[21] Appl. No.: 641,847

[22] Filed: Aug. 17, 1984

[30] Foreign Application Priority Data

Sep. 12, 1983 [IT] Italy ..... 3559 A/83

[51] Int. Cl.[4] ..... G01N 1/04

[52] U.S. Cl. ..... 73/863.92; 198/346.2

[58] Field of Search ..... 73/863.91, 863.92, 863.01; 198/339, 341

[56] References Cited

U.S. PATENT DOCUMENTS

| | | | |
|---|---|---|---|
| 2,601,786 | 7/1952 | Best | 73/863.91 X |
| 3,333,648 | 8/1967 | Dodd | 73/863.92 X |
| 3,383,830 | 5/1968 | Dearsley | 198/339 X |
| 3,435,685 | 4/1969 | Watkin et al. | 73/863.91 |
| 3,492,874 | 2/1970 | Morradi | 73/863.91 |
| 3,878,726 | 4/1975 | Hamatani | 73/863.91 |
| 3,982,439 | 9/1976 | Reth et al. | 73/863.92 |
| 4,363,235 | 12/1982 | Valliens et al. | 73/863.91 X |

FOREIGN PATENT DOCUMENTS

| | | | |
|---|---|---|---|
| 769232 | 8/1934 | France | 73/863.92 |
| 375463 | of 1932 | United Kingdom | 73/863.01 |

*Primary Examiner*—Stewart J. Levy
*Assistant Examiner*—Tom Noland
*Attorney, Agent, or Firm*—Marshall, O'Toole, Gerstein, Murray & Bicknell

[57] ABSTRACT

Method for sampling cigarettes on a filter assembly machine whereby a cigarette is picked out of a respective recess at a first point on a line feeding the cigarettes through the filter assembly machine and, after being fed to at least one checking station, is fed back on to the line at a second point on the same, downstream from the first point. Such feedback is performed when an empty recess, from which another cigarette for inspection has been removed at the first point, passes through the second point.

6 Claims, 2 Drawing Figures

METHOD FOR SAMPLING CIGARETTES ON A FILTER ASSEMBLY MACHINE

BACKGROUND OF THE INVENTION

The present invention relates to a method for sampling cigarettes on a filter assembly machine.

Cigarettes on filter assembly machines are generally subjected to two main types of inspection, the first comprising a "condition" inspection, usually conducted on all the cigarettes, and the second comprising a "ventilation" inspection, usually conducted statistically on sample cigarettes picked off the cigarette manufacturing line at a preset frequency.

On known types of filter assembly machines, the sample cigarettes picked off the line are generally taken away and disposed of after inspection.

As modern filter assembly machines are designed for producing thousands of cigarettes a minute, disposing, for example, of one cigarette per hundred amounts to the disposal of a few packs a minute, which means a considerable loss in economic terms.

SUMMARY OF THE INVENTION

The aim of the present invention is to provide a method for sampling cigarettes on a filter assembly machine whereby sample cigarettes can be picked off the production line and, if necessary, fed back on to the line after inspection.

A further aim of the present invention is to provide a cigarette sampling menthod which, besides enabling cigarettes to be inspected practically on-line, also enables inspection time to be regulated as required.

With these aims in view, the present invention relates to a method for sampling cigarettes on a filter assembly machine, the said method being characterised by the fact that it comprises stages consisting in:

picking a first cigarette, by means of first conveying means, out of a respective recess at a first point on a line feeding the cigarettes through the said machine;

feeding the said first cigarette, by means of the said first conveying means, to second conveying means travelling in preset manner as required through at least one cigarette checking station;

withdrawing a further cigarette for inspection off the said line at the said first point; and feeding the said first cigarette, by means of third conveying means, back on to the said conveyor line at a second point on the line, downstream from the said first point in the travelling direction of the said line;

the said further withdrawal and the said feedback of the said first cigarette being timed in relation to each other in such a manner that the recess left empty on the said line following the said further withdrawal occupies the said second point when the said first cigarette is fed back on to the said line.

BRIEF DESCRIPTION OF THE DRAWINGS

Further characteristics and advantages of the present invention will now be described with reference to the attached drawings showing two non-limiting arrangements and in which.

DETAILED DESCRIPTION OF THE INVENTION

Figure 1:
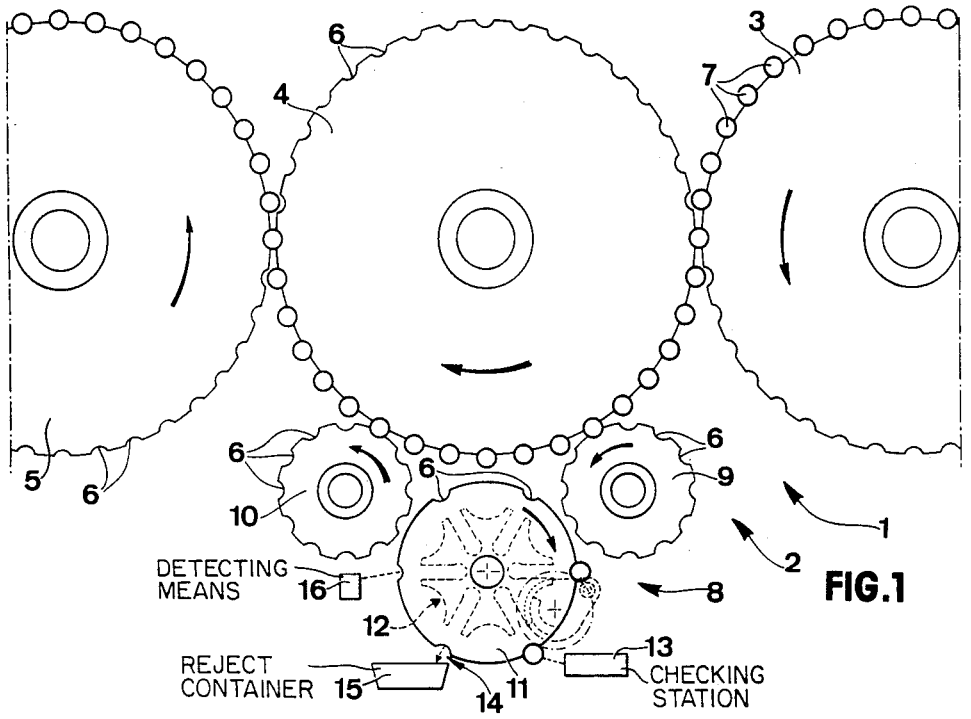
FIG. 1 shows a side view of a first arrangement of a device for performing the method covered by the present invention.

Number 1 in FIG. 1 indicates a conveyor line on a filter assembly machine indicated as a whole by number 2.

Line 1 comprises a series of three rollers, 3, 4 and 5, arranged essentially in line and tangent with one another and each provided with a number of peripheral axial recesses 6 designed to accommodate and hold, by means of suction means not shown, respective cigarettes 7.

Roller 4, set up between rollers 3 and 5, turns round its own axis in the opposite direction to rollers 3 and 5 and is connected to a sampling unit indicated as a whole by number 8.

The latter comprises conveying means consisting of an input roller 9 and an output roller 10, both arranged essentially tangent with a first and second point on the peripheral section of roller 4 travelled along by cigarettes 7 as they are fed along line 1.

Rollers 9 and 10 turn round their respective axes at the same speed as and in the opposite direction to roller 4 and are provided on the outer surface with a number of axial recesses 6 the number of which, as explained in more detail later on, may be extremely small.

Sampling unit 8 also comprises conveying means consisting of a roller 11 the outer periphery of which, arranged essentially tangent with rollers 9 and 10, is provided with a number of equidistant axial recesses 6 designed to accommodate and hold respective cigarettes 7.

Roller 11 is designed to turn in steps round its own axis in the same direction as roller 4, for which purpose, roller 11 is driven by connecting it to the drive (not shown) on line 1 with a Maltese cross mechanism 12 inbetween. The latter is designed in such a manner as to impart on roller 11, as it moves forward one step, a speed ranging from zero to at least the same speed as rollers 9 and 10.

Round the outer periphery of roller 11, provision is made, in succession, for a checking station 13 for cigarettes 7 and a reject station 14 with a container 15 for the rejected cigarettes.

During operation, cigarettes 7 proceed normally along line 1 until, in response to a control signal supplied either automatically at a preset frequency or as required by an operator, a suction device (not shown) on roller 9 is activated.

The latter extracts a cigarette 7 from a respective seat 6 on roller 4 and feeds it towards its point of tangency with roller 11. The latter is activated by the said control signal in such a manner as to move forward one step at variable speed, so that one of its recesses 6 faces recess 6 on roller 9 occupied by the said cigarette 7 picked off roller 4, when the said cigarette reaches the point of tangency between rollers 9 and 11. Furthermore, device 12 is designed in such a manner that, when cigarette 7 on roller 9 reaches the said point of tangency, the speed of roller 11 is the same as that of roller 9.

Activating a suction system (not shown) on roller 11 enables the said cigarette 7 to be transferred from roller 9 to roller 11, which feeds it forward from the pick-up position to checking station 13 where cigarette 7 is held up for the time needed to carry out inspection as required. Once inspected, cigarette 7 is fed forward by step roller 11 towards roller 10 and through reject station 14, where cigarette 7 may be rejected by roller 11 into container 15, if any faults have been detected during inspection at station 13.

If not, cigarette 7 is fed forward towards the point of tangency between rollers 11 and 10 and is transferred into a recess 6 on roller 10 in the same way as from roller 9 to 11 already described.

Transferring cigarette 7 from roller 11 to roller 10 is made possible by detecting means 16 which, detecting the arrival of a cigarette on roller 11 towards roller 10, activate suction means (not shown) on roller 10 when the said cigarette 7 reaches the point of tangency between rollers 10 and 11. The said detecting means 16 also activate the suction means on roller 9 so as to cause the latter to pick a cigarette 7 off roller 4.

Figure 2:
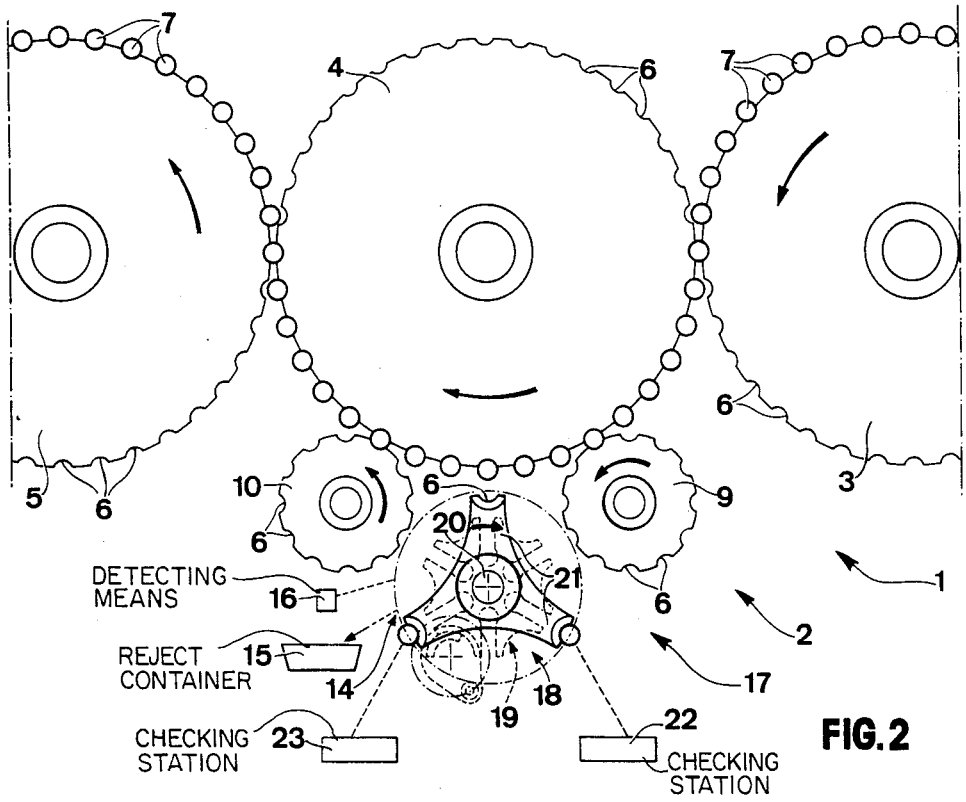
FIG. 2 shows a side view of a second arrangement of a devidce for performing the method covered by the present invention.

This is done in such a manner that, when the cigarette 7 on roller 10 reaches the point of tangency between rollers 10 and 4, the said cigarette 7 is received by the recess 6 left empty by the cigarette 7 picked off by roller 9. FIG. 2 shows a sampling unit 17 on which roller 11 is replaced by a conveyor 18 which can be made to jog clockwise by a Maltese cross mechanism 19 similar to the said mechanism 12. Conveyor 18 is supported and driven by a shaft 20, perpendicular to the plane in the Figure, and comprises three radial arms 21, integral with shaft 20, angularly equidistant from one another and each provided at the free end with an axial recess 6 designed to accommodate a cigarette 7.

With conveyor 18 at a standstill, one arm 21 is arranged essentially vertical between rollers 9 and 10, whereas the other two arms 21 are positioned with their recesses 6, and any cigarettes 7 inside them, over respective checking stations 22 and 23.

The manner in which cigarettes 7 are transferred between rolloers 4, 9 and 10, picked off roller 9 by conveyor 18 and fed back on to roller 10 is exactly the same on sampling unit 17 as on sampling unit 8.

Each cigarette 7 picked up by conveyor 18 is fed, as the conveyor moves forward one step, to station 22 where it is subjected to a first type of inspection.

As conveyor 18 moves forward another step, it receives another cigarette 7 from roller 9 and feeds the cigarette 7 from station 22 to station 23 for further inspection. As conveyor 18 moves forward yet another step, cigarette 7 from station 23 is fed through reject station 14 where it may be dropped off conveyor 18 into container 15, if any faults have been detected in checking stations 22 and 23. If not, it is fed towards roller 10 from which it is fed back on to roller 4.

Needless to say, the number of arms 21 may differ from the example shown, as may the number of checking stations along the route travelled by cigarette 7 on conveyor 18.

We claim:

1. Method for sampling cigarettes (7) on a filter assembly machine (2), the said method being characterised by the fact that it comprises stages consisting in:

picking a first cigarette (7), by means of first conveying means (9), out of a cigarette carrying recess (6) at a first point on a line (1) feeding the cigarette (7) through the said machine (2);

feeding the said first cigarette (7), by means of the said first conveying means (9), to second conveying means (11 or 18) travelling in preset manner through at least one cigarette (7) checking station (13 or 22, 23);

withdrawing a further cigarette (7) for inspection off the said line (1) at the said first point; and feeding the said first cigarette (7), by means of third conveying means (10), back on to the said conveyor line (1) at a second point on the line (1), downstream from the said first point in the travelling direction of the said line (1);

the said further withdrawal and the said feedback of the said first cigarette (7) being timed in relation to each other in such a manner that the recess (6) left empty on the said line (1) following the said further withdrawal occupies the said second point when the said first cigarette (7) is fed back on to the said line (1).

2. A method as claimed in claim 1, wherein said line (1) comprises at least one conveying roller (4), on the pheriphery of which a plurality of cigarette carrying recesses are provided, said first and second points being at said periphery.

3. Method according to claim 2, characterised by the fact that the said first conveying means comprise an input roller (9) arranged essentially tangent with the said roller (4) on the said line (1) at the said first point, and designed to turn round its own axis at a pheripheral speed equal to the speed of said line (1); the said third conveying means comprising an output roller (10) essentially tangent with the said roller (4) on the said line (1) at the said second point and designed to turn round its own axis at a pheripheral speed equal to the speed of said line (1).

4. Method according to claim 3, characterised by the fact that the said second conveying means comprise a further conveying roller (11) essentially tangent with the said input (9) and output (10) rollers; the said further roller (11) turning in steps round its own axis at a variable peripheral speed ranging from zero to at least the same peripheral speed as the said input (9) and output (10) rollers.

5. Method according to claim 3, characterised by the fact that the said second conveying means comprise a conveyor (18) having a number of arms (21) arranged radially in relation to a supporting and drive shaft (20), being angularly equidistant from one another and being provided on the end with respective recesses (6) for accommodating cigarettes (7) and designed to move, following rotation of the said shaft (20), round a trajectory essentially tangent with the said input (9) and output (10) rollers; the said conveyor (18) being designed to turn in steps round the axis of the said shaft (20) and the speed of the said recesses (6) being variable from zero to at least the same peripheral speed as the said input (9) and output (10) rollers.

6. Method according to claim 4, characterised by the fact that each cigarette (7) picked up at the said first point is inspected at the said at least one checking station (13 or 22, 23) as it is being transferred by the said second conveying means (11 or 18) during the course of at least one hold stage of the same.

* * * * *